US007583923B2

(12) United States Patent
Chung et al.

(10) Patent No.: US 7,583,923 B2
(45) Date of Patent: Sep. 1, 2009

(54) BEARING STRUCTURE AND FUSING DEVICE FOR IMAGE FORMING APPARATUS EMPLOYING THE BEARING STRUCTURE

(75) Inventors: Kyung-shig Chung, Suwon-si (KR); Jin-yoon Kim, Suwon-si (KR); Sung-hoon Hong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/099,595

(22) Filed: Apr. 6, 2005

(65) Prior Publication Data

US 2005/0249531 A1 Nov. 10, 2005

(30) Foreign Application Priority Data

May 6, 2004 (KR) ..... 10-2004-0031666
May 11, 2004 (KR) ..... 10-2004-0033101

(51) Int. Cl.
*G03G 15/20* (2006.01)

(52) U.S. Cl. ..... 399/328

(58) Field of Classification Search ..... 399/328
See application file for complete search history.

(56) References Cited

U.S. PATENT DOCUMENTS 4,527,913 A * 7/1985 Seifert ..... 384/215
4,616,886 A 10/1986 Teramachi
5,070,373 A * 12/1991 Fukano et al. ..... 399/322
5,289,651 A * 3/1994 Byers ..... 40/533

FOREIGN PATENT DOCUMENTS

| | | | |
|---|---|---|---|
| JP | 58-005764 | | 1/1983 |
| JP | 62073286 A | * | 4/1987 |
| JP | 4-8796 | | 2/1992 |
| JP | 08-297425 | | 2/1992 |
| JP | 05-026228 | | 2/1993 |
| JP | 05-204275 | | 8/1993 |
| JP | 06-208314 | | 7/1994 |
| JP | 08-021439 | | 1/1996 |
| JP | 08-284959 | | 1/1996 |
| JP | 07-077917 | | 3/1996 |

(Continued)

*Primary Examiner*—Quana M Grainger
(74) *Attorney, Agent, or Firm*—Roylance, Abrams, Berdo & Goodman, L.L.P.

(57) ABSTRACT

A bearing structure reduces friction between a roller and a bearing under a pressure. A fusing device for an image forming apparatus employs the bearing structure. The bearing structure installed between a frame and a rotary shaft supports the rotary shaft on the frame. A bearing body has a fitting part in which the rotary shaft is rotatably fitted. A rolling support unit is installed on at least one portion inside the fitting part to contact the rotary shaft in a rolling manner. The fusing device includes a fusing roller in which a heater is embedded, and a pressure roller that faces the fusing roller and cooperates with the fusing roller in pressing a sheet of paper passing therebetween. Bearing structures rotatably support the fusing roller and the pressure roller on a frame. Each bearing structure includes a bearing body having a fitting part, and a rolling support unit installed on at least one area inside the fitting part to contact the fitted roller in a rolling manner.

2 Claims, 12 Drawing Sheets

FOREIGN PATENT DOCUMENTS

| | | | | |
|---|---|---|---|---|
| JP | 08297425 | A | * | 11/1996 |
| JP | 09-016013 | | | 1/1997 |
| JP | 10-009254 | | | 1/1998 |
| JP | 11-073052 | | | 3/1999 |
| JP | 11352808 | A | * | 12/1999 |
| JP | 2000231290 | A | * | 8/2000 |
| JP | 2000-242113 | | | 9/2000 |
| JP | 13-134117 | | | 5/2001 |
| JP | 2001-134117 | | | 5/2001 |
| JP | 2001-349326 | | | 12/2001 |
| JP | 2002040829 | A | * | 2/2002 |
| JP | 2005258161 | A | * | 9/2005 |
| KR | 1998-024539 | | | 7/1998 |
| KR | 1998-077741 | | | 11/1998 |

* cited by examiner

BEARING STRUCTURE AND FUSING DEVICE FOR IMAGE FORMING APPARATUS EMPLOYING THE BEARING STRUCTURE

CROSS REFERENCE TO RELATED APPLICATIONS

This application claims the benefit under 35 U.S.C § 119(a) of Korean Patent Application Nos. 10-2004-0031666, filed on May 6, 2004 and 10-2004-0033101, filed on May 11, 2004, in the Korean Intellectual Property Office, the entire disclosures of both of which are hereby incorporated by reference.

BACKGROUND OF THE INVENTION

1. Field of the Invention

The present invention relates to a bearing structure that rotatably supports a roller and a fusing device for an image forming apparatus employing the bearing structure. More particularly, the present invention relates to a bearing structure that reduces friction between a roller and a bearing under pressure and a fusing device for an image forming apparatus employing the bearing structure.

2. Description of the Related Art

In general, bearing structures are employed to rotatably support a roller on a fixed frame. That is, bearing structures are installed at both sides of a roller to be connected between the roller and the frame, and to rotatably support the roller.

Bearing structures are divided into a ball bearing type, which rotatably supports a roller by balls that roll between an inner wheel and an outer wheel, and a sliding bearing type, which is made of plastic material and rotatably supports a roller by allowing the roller to slide. The ball bearing is superior in performance to the sliding bearing, but has a complex structure, thereby increasing the number of assembling processes and manufacturing costs. Accordingly, the sliding bearing, which can be mass produced easily at low costs, is widely used.

In general, electrophotographic image forming apparatuses print an image on a sheet of paper by emitting light to a photosensitive medium charged at a predetermined potential to form an electrostatic latent image, developing the electrostatic latent image with toner of a predetermined color to form a toner image, and transferring and fusing the toner image. The image forming apparatuses employ a fusing device in a printing path to fuse the transferred image on the sheet of paper.

Referring to FIGS. 1 and 2, a conventional image forming apparatus includes a frame 1, a fusing roller 11 installed for being rotatable on a frame 1, a heater 15 embedded in the fusing roller 11 for heating a surface of the fusing roller 11, a pressure roller 21 rotatably installed on the frame 1 for pressing a printing paper P with the fusing roller 11, and bearing structures 30 for rotatably supporting the fusing roller 11 and the pressure roller 21.

Each of the bearing structures 30 includes a sliding bearing 31 installed on the frame 1, and an elastic member 35 for supporting elastically the sliding bearing 31. The sliding bearing 31 is made of plastic material, and has a bearing groove 33 into which the fusing roller 11 or the pressure roller 21 is rotatably inserted. Here, a clearance is formed between an inner surface of the bearing groove 33 and an outer surface of each of the fusing roller 11 and the pressure roller 21. A fluid is injected into the clearance, and guides the fusing roller 11 and the pressure roller 21, thereby helping them to slide during their rotation. The elastic member 35 elastically supports the sliding bearing 31 in a predetermined direction, and the pressure roller 21 presses the fusing roller 11.

In this manner, if the fusing roller 11 and the pressure roller 21 are rotatably supported while pressure is applied therebetween in a predetermined direction, a predetermined area on the inner surface of the bearing groove 33, that is, an area A formed in a direction opposite to the direction in which the pressure is applied, has a narrower clearance than other areas, such that the area A directly contacts the fusing roller 11 or the pressure roller 21 with a higher load.

With the increase in the load, the sliding bearing 31 may be worn, and the system may operate wrongly or halt. Further, foreign substances C generated during the wear may remain inside the bearing groove 33, thereby causing the bearing to operate abnormally.

In the meantime, it can be considered that the fusing device can employ a ball bearing. However, since the ball bearing is large and a mold bearing should be used inside the ball bearing, the ball bearing has a complex structure and increases the number of assembling processes and manufacturing costs as compared to the sliding bearing.

Further, since the ball bearing is made of metal material stronger than the plastic material of the sliding bearing, even when the fusing roller is heated by the heater installed thereinside to an abnormally high temperature where plastic material may be deformed, the ball bearing is not deformed. In the meanwhile, a general fusing device employs a fuse, which determines whether the bearing is overheated based on the degree of deformation of the heated bearing and stops the heating if it is determined to be overheated. Accordingly, if the fusing device constructed as above employs the ball bearing, the bearing is not deformed at an abnormally high temperature, thereby increasing the possibility of fires. Thus, the fusing device employing the fuse cannot be used.

SUMMARY OF THE INVENTION

The present invention provides a bearing structure having a sliding bearing to substantially prevent a friction during operation, and a fusing device for an image forming apparatus employing the bearing structure.

According to an aspect of the present invention, there is provided a bearing structure installed between a frame and a rotary shaft for rotatably supporting the rotary shaft on the frame. The bearing structure has a bearing body having a fitting part in which the rotary shaft is rotatably fitted. A rolling support unit is installed on at least one portion inside the fitting part for contacting the rotary shaft in a rolling manner.

According to another aspect of the present invention, a fusing device for an image forming apparatus has a fusing roller in which a heater is embedded and a pressure roller that faces the fusing roller and cooperates with the fusing roller in pressing a sheet of paper passing therebetween. Bearing structures rotatably support the fusing roller and the pressure roller on a frame. Each of the bearing structures has a bearing body, which has a fitting part in which at least one of the fusing roller and the pressure roller is rotatably fitted; and a rolling support unit installed on at least one portion inside the fitting part for contacting the fitted roller in a rolling manner.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
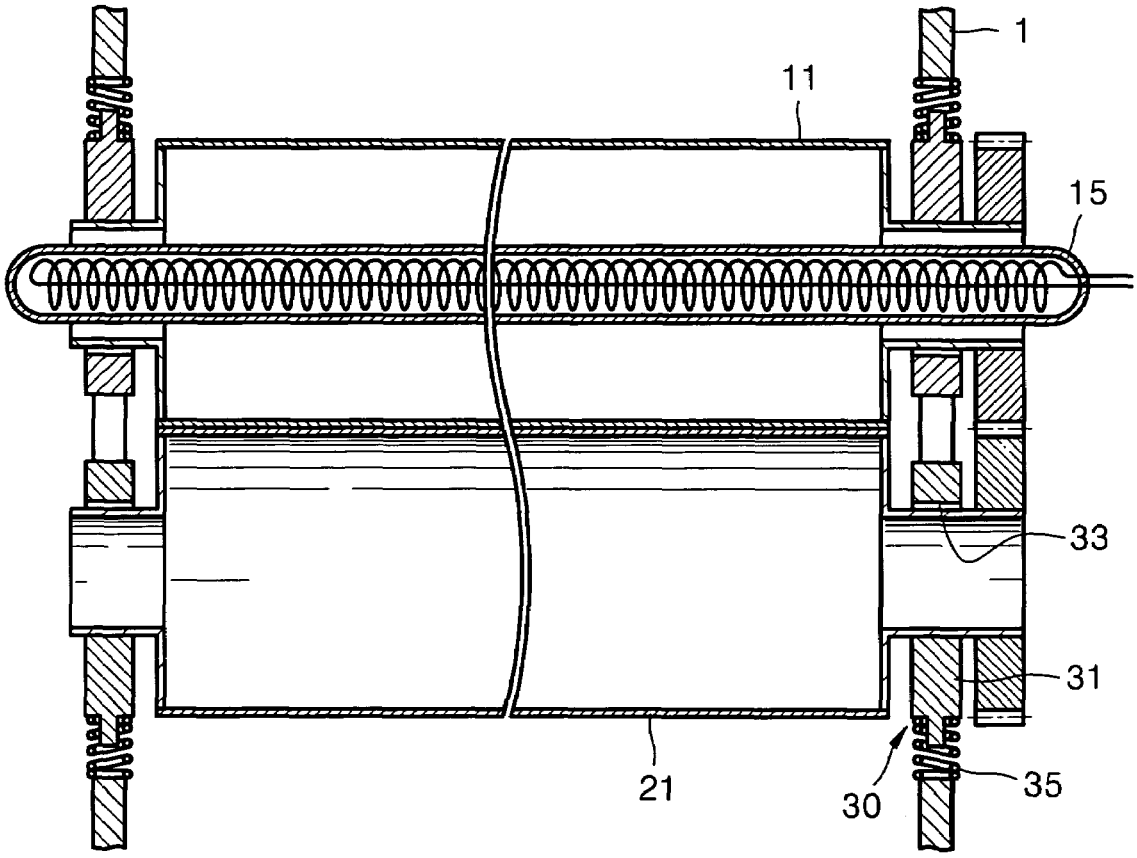
FIG. 1 (PRIOR ART)
FIG. 1 is a schematic sectional view of a conventional fusing device for an image forming apparatus.
Figure 2:
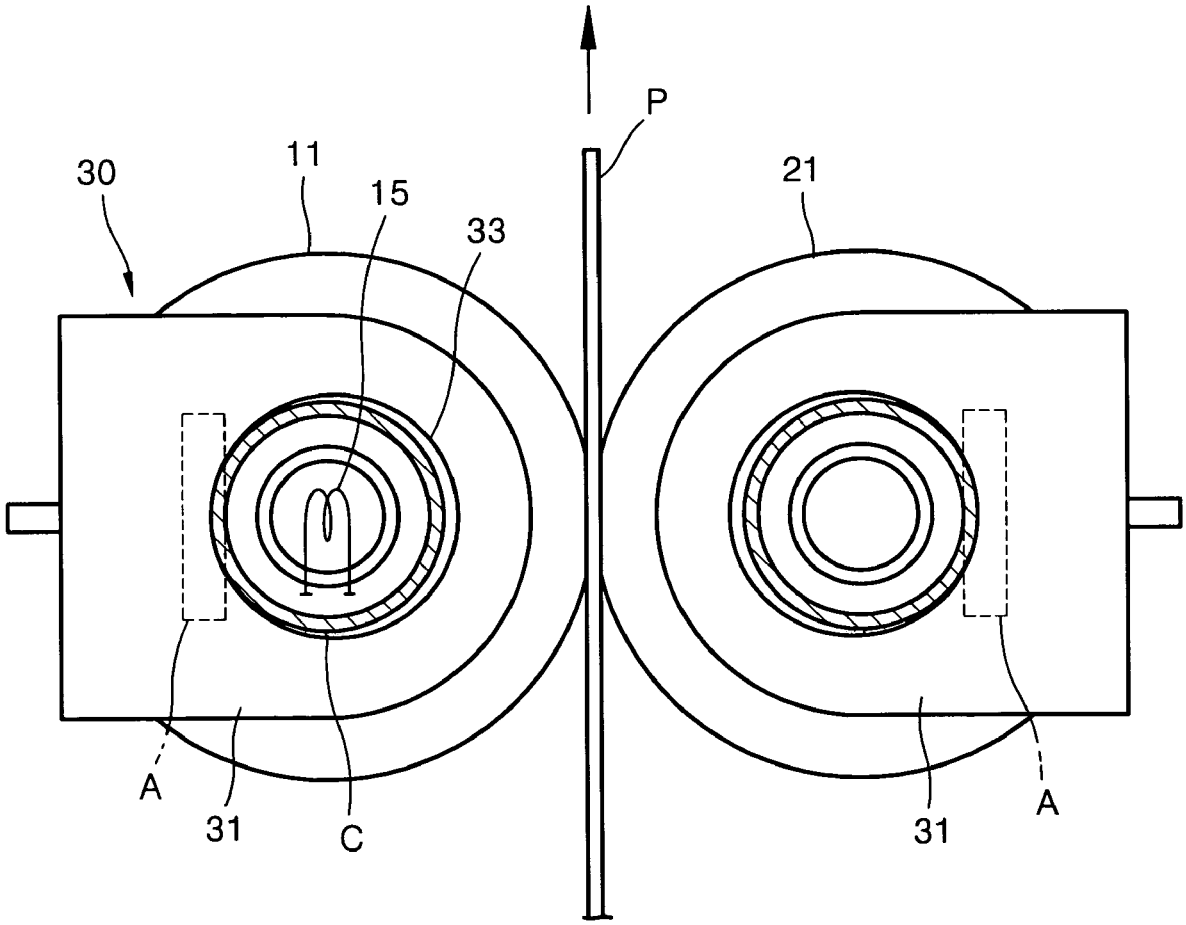
FIG. 2 (PRIOR ART)
FIG. 2 is a schematic sectional view illustrating the operation of the fusing device shown in FIG. 1.
Figure 3:
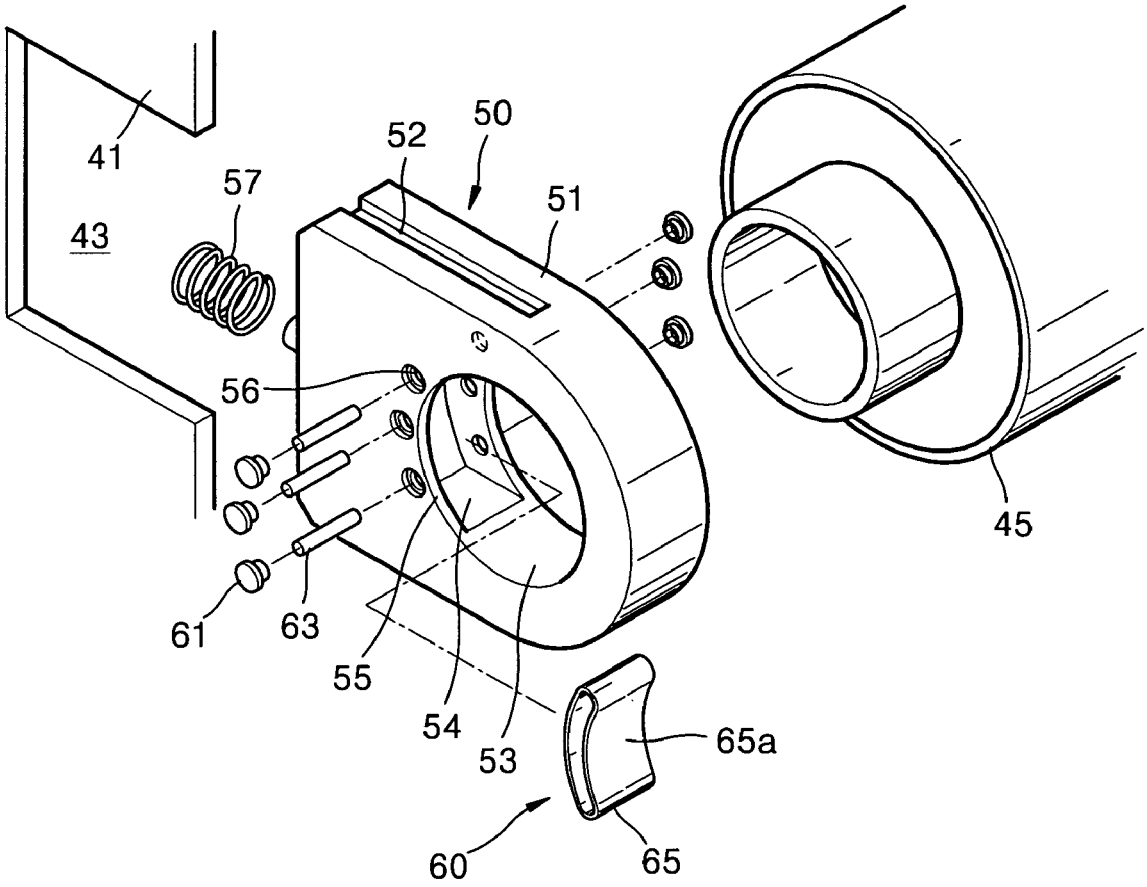
FIG. 3 is an exploded perspective view of a bearing structure according to a first embodiment of the present invention.
Figure 4:
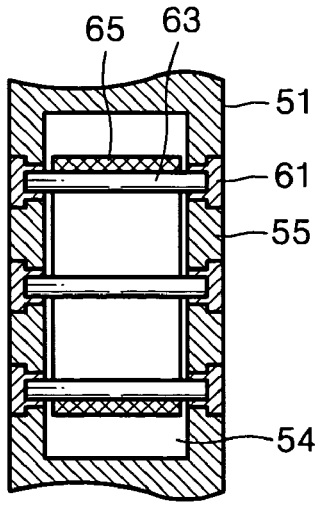
FIG. 4 is a schematic sectional view of the bearing structure of FIG. 3.

Referring to FIGS. 3 and 4, a bearing structure 50 according to an exemplary embodiment of the present invention is installed between a frame 41 and a rotary shaft 45, and rotatably supports the rotary shaft 45 on the frame 41. The bearing structure 50 includes a bearing body 51 having a fitting part 53 in which the rotary shaft 45 is rotatably fitted, and a rolling support unit 60 installed inside the fitting part 53 for contacting the rotary shaft 45 in a rolling manner.

The frame 41 has a space 43 in which the bearing structure 50 is installed. The bearing structure 50 has guide grooves 52 formed on both upper and lower sides thereof so that the bearing structure 50 may be slidably inserted into the space 43. Accordingly, both extensions of the frame 41 formed by the space 43 are inserted into the guide grooves 52, such that the bearing structure 50 may be installed on the frame 41. Here, the method of coupling the bearing structure 50 to the frame 41 is exemplary, and various modifications may be made.

Preferably, an elastic member 57 is interposed between the bearing body 51 and the frame 41. The elastic member 57 elastically presses the bearing body 51 to the frame 41 in a predetermined direction. Accordingly, if the bearing structure 50 rotatably supports the rotary shaft 45 while the elastic member 57 presses the bearing body 51 in the predetermined direction, a predetermined pressure may be applied to the rotary shaft 45 due to an elastic biasing force of the elastic member 57.

The bearing structure 50 is a type of sliding bearing, and is made of a plastic material that preferably has a high resistance to heat and friction caused during its rotatably supporting function. That is, the rotary shaft 45 is slidably fitted in the fitting part 53 formed on the bearing body 51 so as to freely rotate.

A clearance is formed between an inner wall of the fitting part 53 and the rotary shaft 45. A fluid may be injected into the clearance to facilitate rotation of the rotary shaft 45. In the meantime, when the rotary shaft 45 is pressed in the predetermined direction, the clearance becomes eccentric to one direction such that a specific portion has a narrower clearance.

The rolling support unit 60 is installed on the specific portion with the narrower clearance, and contacts the rotary shaft 45 in a rolling manner.

An installation groove 54 is formed within at least one area of the fitting part 53, for example, within the portion with the narrower clearance, to receive the rolling support unit 60. Here, the bearing body 51 has side walls 55 of a predetermined thickness extending along both sides of the installation groove 54, and a plurality of coupling grooves 56 are formed on the side walls 55.

The rolling support unit 60 includes a plurality of bushings 61, a plurality of guide shafts 63 freely rotatably coupled to the bushings 61, respectively, and a support belt 65 surrounding the guide shafts 63.

The plurality of bushings 61 are attached to the side walls 55 of the fitting part 53, and rotatably support the guide shafts 63, respectively. The plurality of guide shafts 63 are placed on predetermined positions inside the fitting part 53, and both ends of each guide shaft 63 are rotatably installed on each bushing 61. Accordingly, the guide shafts 63 may freely rotate inside the fitting part 53 when an external force is applied to the guide shafts 63.

The support belt 65 surrounds the plurality of guide shafts 63. That is, in the state where the support belt 65 is disposed inside the installation groove 54, the guide shafts 63 pass through the support belt 65 to be coupled to the bushings 61, as shown in FIG. 4.

exposed surface 65*a* of the support belt 65 mounted in the fitting part 53 directly contacts the rotary shaft 45. Accordingly, the support belt 65 is operatively connected to the rotary shaft 45 such that the support belt 65 is moved in a rotational direction of the rotary shaft 45. At this time, since the guide shafts 63 are rotatably coupled to the bushings 61, the guide shafts 63 facilitate movement of the support belt 65.

Figure 5:
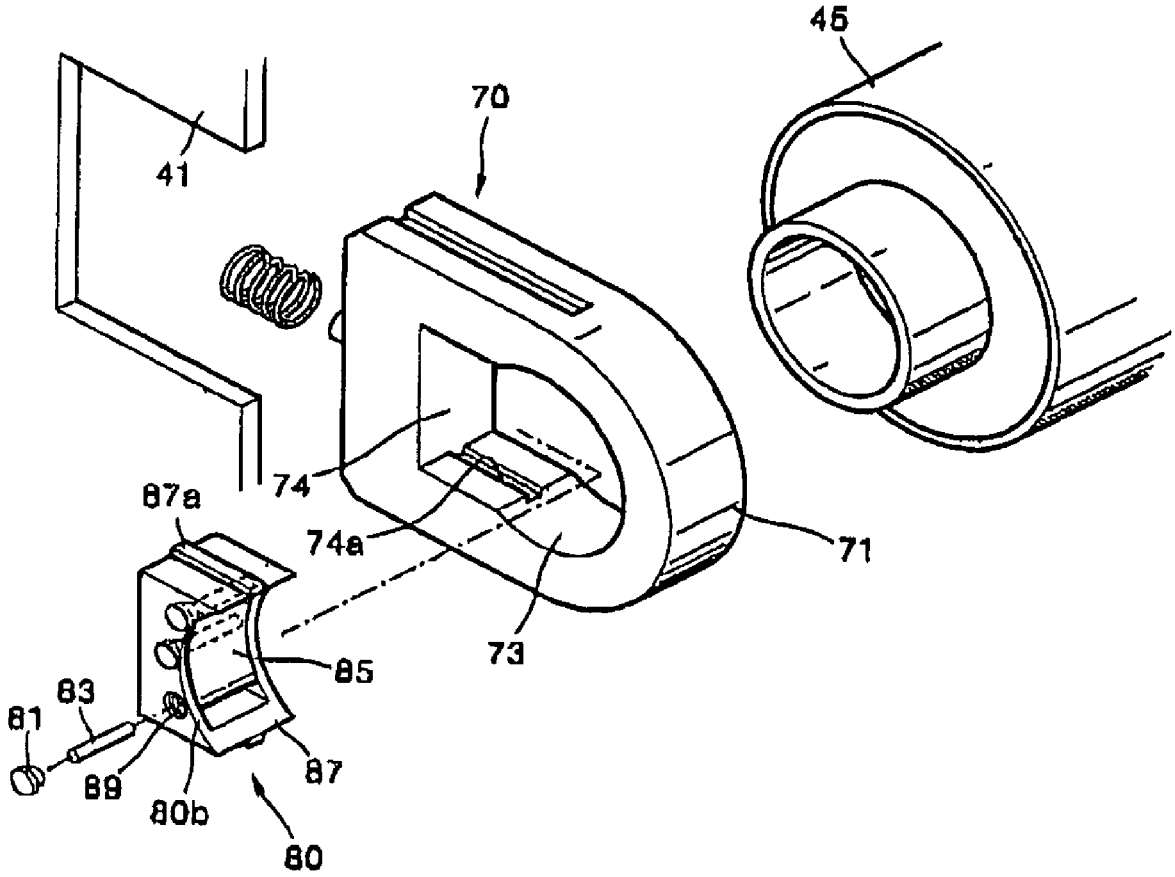
FIG. 5 is an exploded perspective view of a bearing structure according to a second embodiment of the present invention.

Referring to FIG. 5, a bearing structure 70 according to another exemplary embodiment of the present invention is installed between the frame 41 and the rotary shaft 45 and rotatably supports the rotary shaft 45 on the frame 41. The bearing structure 70 includes a bearing body 71 having a fitting part 73 in which the rotary shaft 45 is rotatably fitted. A rolling support unit 80 is installed inside the fitting part 73 for contacting the rotary shaft 45 in a rolling manner.

The bearing structure 70 of the exemplary embodiment illustrated in FIG. 5 is different from the bearing structure 50 according to the previous embodiment described with reference to FIGS. 3 and 4 in that the rolling support unit 80 has a separate independent structure and may be installed on the fitting part 73. Accordingly, an explanation will be given focusing on the difference, and a detailed explanation of other elements will not be given.

To this end, the bearing body 70 has a space part 74 formed on at least one area inside the fitting part 73. The rolling support unit 80, which is a single body, is mounted in the space part 74.

The rolling support unit 80 includes a housing 87 having a dented inner space formed thereon, a plurality of bushings 81, a plurality of guide shafts 83, and a support belt 85.

the state where the plurality of bushings 81, the plurality of guide shafts 83, and the support belt 85 are assembled, the housing 87 is mounted in the space part 74. Here, the housing 87 may be mounted in the space part 74 by bonding means, e.g., an adhesive, screws, or hooks. For example, the housing 87 may be mounted in the space part 74 using guide grooves 74*a* and guide rails 87*a,* which are correspondingly formed on the space part 74 and the housing 87, respectively, as shown in FIG. 5.

The housing 87 has side walls extending along both sides of the dented inner space thereof, and a plurality of coupling grooves 89 are formed on the side walls 88. The bushings 81 are inserted into the coupling grooves 89, respectively. The guide shafts 83 are rotatably coupled to the bushings 81, respectively, and guide the support belt 85 to facilitate rotation.

An exposed surface of the support belt 85 mounted in the fitting part 73 directly contacts the rotary shaft 45 in a rolling manner, such that the support belt 85 is operatively connected to the rotary shaft 45 and thus is moved in a rotational direction of the rotary shaft 45.

Figure 6:
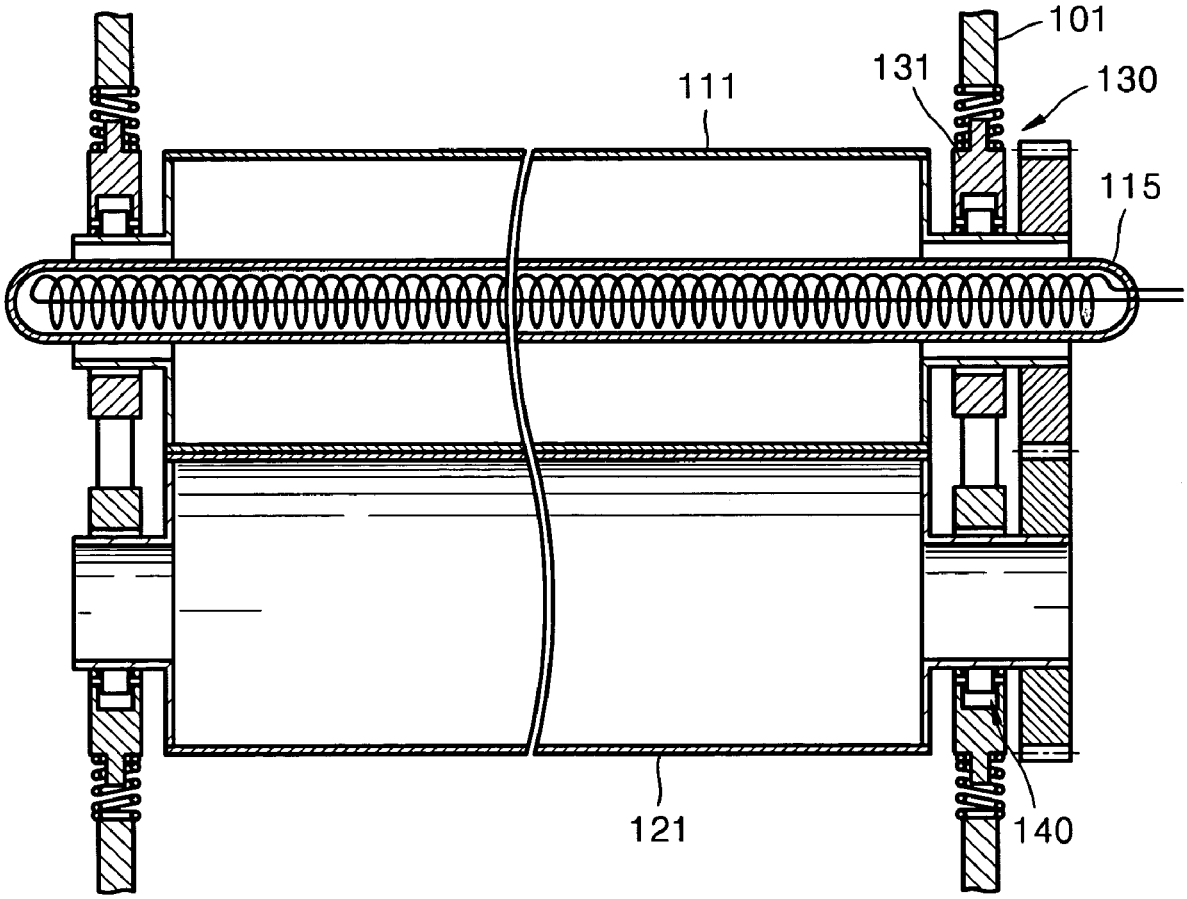
FIG. 6 is a schematic sectional view of a fusing device for an image forming apparatus according to a first embodiment of the present invention.
Figure 7:
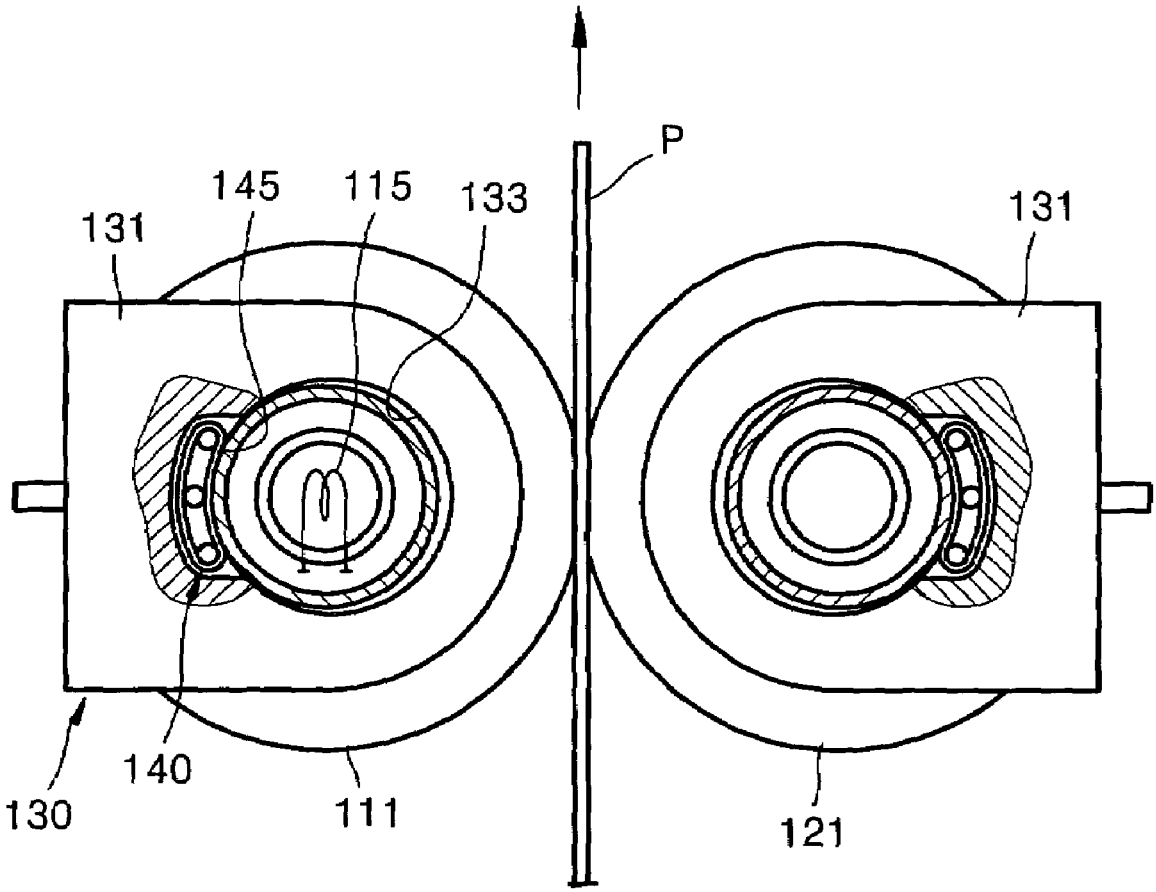
FIG. 7 is a schematic sectional view illustrating the operation of the fusing device of FIG. 6.

Referring to FIGS. 6 and 7, a fusing device for an image forming apparatus according to an exemplary embodiment of the present invention includes a fusing roller 111, and a pressure roller 121 rotatably installed in contact with the fusing roller 112. Bearing structures 130 rotatably support the fusing roller 111 and the pressure roller 121 on a frame 101.

The fusing roller 111 is rotatably installed on the frame 101 through the bearing structure 130. A heater 115 is embedded inside the fusing roller 111. Accordingly, the fusing roller 111 cooperates with the pressure roller 121 to fuse an image transferred to a printing paper P at high temperature and high pressure. The fusing roller 111 and the pressure roller 121 rotate while mutually pressing the printing paper P passing therebetween, areas are formed in directions opposite to the directions in which pressures are applied when the respective bearing structures 130 are coupled to the fusing roller 111 and the pressure roller 121 that have a narrower clearance than other areas.

Each of the bearing structures 130 includes a bearing body 131 having a fitting part 133 in which one of the fusing roller 111 and the pressure roller 121 is rotatably fitted, and a rolling support unit 140 installed on at least one portion inside the fitting part 133 for contacting the fusing roller 111 or the pressure roller 121 in a rolling manner. The rolling support unit 140 includes a support belt 145, which directly contacts the fusing roller 111 or the pressure roller 121 in a rolling manner, and is disposed on an area with a narrower clearance on an inner surface of the fitting part 133, thereby facilitating smooth rotation of the fusing roller 111 or the pressure roller 121.

The bearing structures 130 illustrated in FIGS. 6 and 7 are substantially similar in structure and function to the bearing structures according to the previous embodiments described with reference to FIGS. 3 through 5, such that a detailed explanation thereof will not be given.

Alternatively, although the bearing structures including the rolling support unit support both the fusing roller and the pressure roller in the present embodiment, it is just exemplary, and the bearing structures may support either the fusing roller or the pressure roller.

As described above, since the rolling support unit 140 is employed in the specific portion with a narrower clearance to contact the roller in a rolling manner, not in a frictional manner, a friction between the bearing body 131 and the fusing roller 111 and the pressure roller 121 may be reduced.

Figure 8:
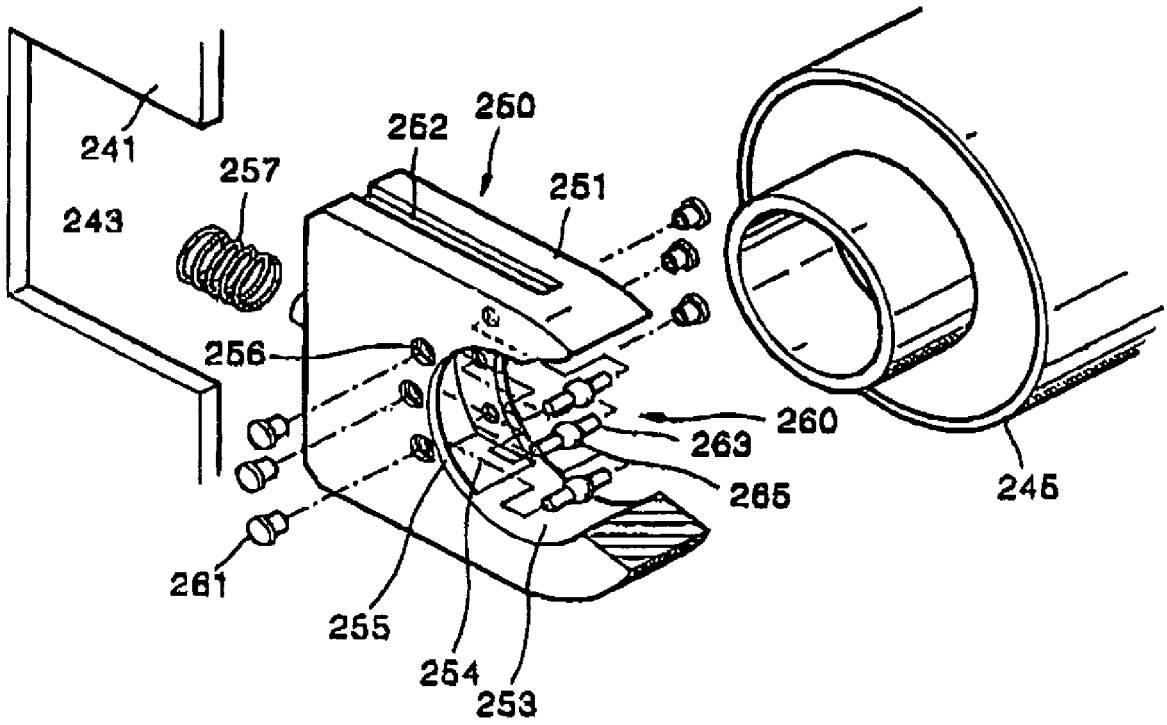
FIG. 8 is an exploded perspective view of a bearing structure according to a third embodiment of the present invention.
Figure 9:
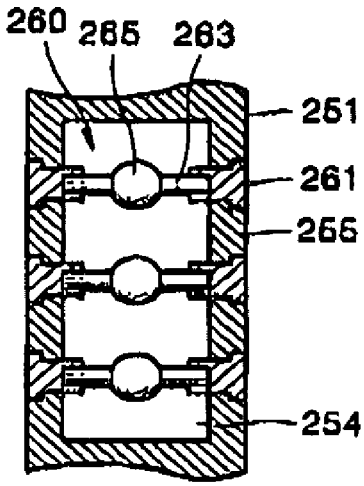
FIG. 9 is a schematic sectional view of the bearing structure of FIG. 8.

Referring to FIGS. 8 and 9, a bearing structure 250 according to another exemplary embodiment of the present invention is installed between a frame 241 and a rotary shaft 245, and rotatably supports the rotary shaft 245 on the frame 241. The bearing structure 250 includes a bearing body 251 having a fitting part 253 in which the rotary shaft 245 is rotatably fitted, and a rolling support unit 260 is installed inside the fitting part 253 for contacting the rotary shaft 245 in a rolling manner.

The frame 241 has a space 243 in which the bearing structure 250 is installed. The bearing structure 250 has guide grooves 252 formed on both upper and lower sides thereof so that the bearing structure 250 may be slidably installed in the space 243 through the guide grooves 252. Accordingly, both extensions of the frame 241 formed by the space 243 are inserted into the guide grooves 252, such that the bearing structure 250 may be installed on the frame 241. Here, the method of coupling the bearing structure 250 to the frame 241 is exemplarily shown, and various modifications may be made thereto.

Preferably, the bearing structure 250 further includes an elastic member 257 that is disposed between the bearing body 251 and the frame 241. The elastic member 257 elastically presses the bearing body 251 to the frame 241 in a predetermined direction. Accordingly, if the bearing structure 250 rotatably supports the rotary shaft 245 while the elastic member 257 presses the bearing body 251 in the predetermined direction, a predetermined pressure may be applied to the rotary shaft 245 due to an elastic biasing force of the elastic member 257.

The bearing structure 250 is a type of sliding bearing, and is made of a plastic material that preferably has a high resistance to heat and friction caused during its rotatably supporting function. That is, the rotary shaft 245 is slidably fitted in the fitting part 253 formed on the bearing body 251 to rotate freely.

A clearance is formed between an inner wall of the fitting part 253 and the rotary shaft 245. A fluid may be injected into the clearance to facilitate rotation of the rotary shaft 245. When the rotary shaft 245 is pressed in the predetermined direction, the clearance becomes eccentric to one direction such that a specific portion has a narrower clearance.

The rolling support unit 260 is installed on the portion with the narrower clearance, and contacts the rotary shaft 245 in a rolling manner.

An installation groove 254 is formed within at least one area of the fitting part 253, for example, within the portion with the narrower clearance, to receive the rolling support unit 260. The bearing body 251 has side walls of a predetermined thickness along both sides of the installation groove 254, and a plurality of coupling grooves 256 are formed on the side walls 255.

The rolling support unit 260 includes a plurality of bushings 261, a plurality of shafts 263 that are freely rotatably coupled to the bushings 261, respectively, and a plurality of convex parts 265 formed on outer peripheries of the shafts 263.

The plurality of bushings 261 are attached to the side walls 255 of the fitting part 253, and rotatably support the shafts 263. Both ends of each shaft 263 are rotatably installed on each bushing 261 in the state where the plurality of shafts 263 are placed on predetermined positions inside the fitting part 253. Accordingly, the plurality of shafts 263 may freely rotate inside the fitting part 253 when an external force is applied to the shafts 263.

Each of the convex parts 265 is formed on a portion of an outer periphery of each of the shafts 263. That is, the convex parts 265 are integrally formed with the shafts 263, or are coupled as separate members to the outer peripheries of the shafts 263.

Exposed surfaces of the convex parts 265 mounted in the fitting part 253 directly contact the rotary shaft 245. Accordingly, the convex parts 265 are operatively connected to the rotary shaft 245 such that the convex parts 265 rotate together with the shafts 263 in a rotational direction of the rotary shaft 245.

Figure 10:
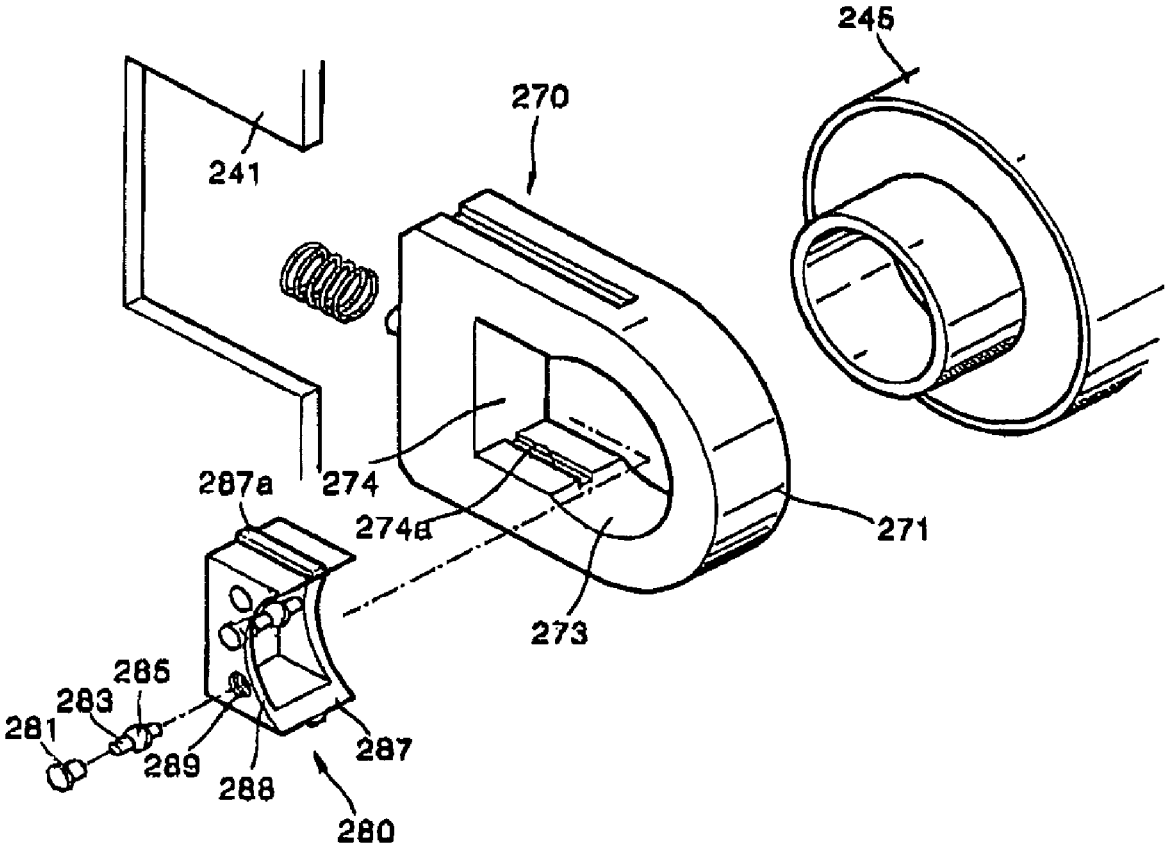
FIG. 10 is an exploded perspective view of a bearing structure according to a fourth embodiment of the present invention.

Referring to FIG. 10, a bearing structure 270 according to another exemplary embodiment of the present invention is installed between the frame 241 and the rotary shaft 245, and rotatably supports the rotary shaft 245 on the frame 241. The bearing structure 270 includes a bearing body 271 having a fitting part 273 in which the rotary shaft 245 is rotatably fitted, and a rolling support unit 280 installed inside the fitting part 273 for contacting the rotary shaft 245 in a rolling manner.

The bearing structure 270 according to the present embodiment illustrated in FIG. 10 is different from the bearing structure 250 according to the previous embodiment described with reference to FIGS. 8 and 9 in that the rolling support unit 280 has a separate independent structure and may be installed on the fitting part 273. Accordingly, an explanation will be given focusing on the difference, and a detailed explanation of other elements will not be given.

The bearing structure 270 has a space part 274 formed on at least one area inside the fitting part 273. The rolling support unit 280, which is a single body, is mounted in the space part 274.

The rolling support unit 280 includes a housing 287 having a dented inner space, a plurality of bushings 281, a plurality of shafts 283, and a plurality of convex parts 285.

The bushings 281, the shafts 283, and the convex parts 285 are assembled inside the housing 287, which is mounted in the space part 274. The housing 287 may be mounted in the space part 274 by bonding means, e.g., an adhesive, screws, or hooks. For example, the housing 287 may be mounted in the space part 274 using guide grooves 274*a* and guide rails 287*a*, which are correspondingly formed on the space part 274 and the housing 287, respectively, as shown in FIG. 10.

The housing 287 has side walls 288 extending along both sides of the dented inner space thereof, and a plurality of coupling grooves 289 are formed on the side walls 288. The bushings 281 are inserted into the coupling grooves 289, respectively, and the shafts 283 are freely rotatably coupled to the bushings 281, respectively.

Exposed surfaces of the convex parts 285 mounted in the fitting part 273 directly contact the rotary shaft 245. Accordingly, the convex parts 285 are operatively connected to the rotary shaft 245 such that the convex parts 285 are moved in a rotational direction of the rotary shaft 245.

Figure 11:
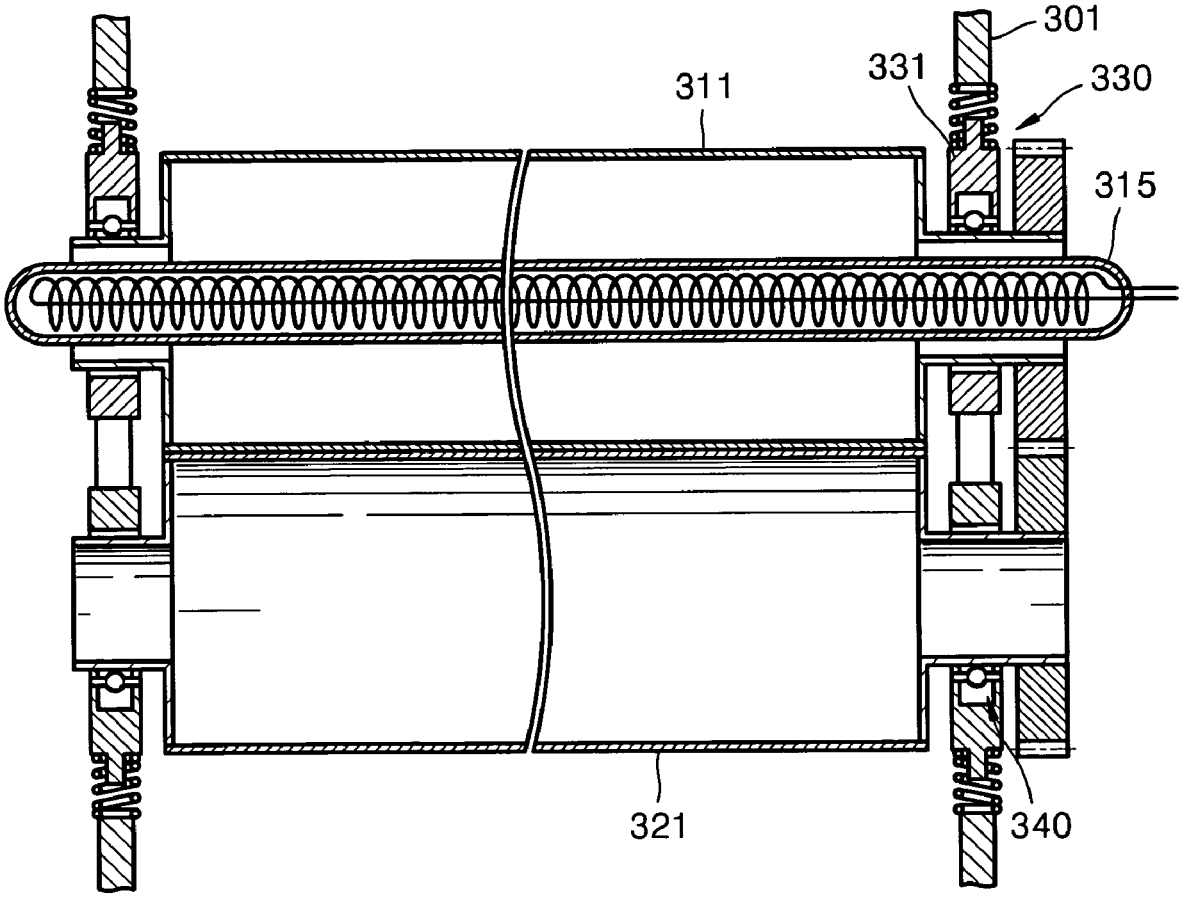
FIG. 11 is a schematic sectional view of a fusing device for an image forming apparatus according to a second embodiment of the present invention.
Figure 12:
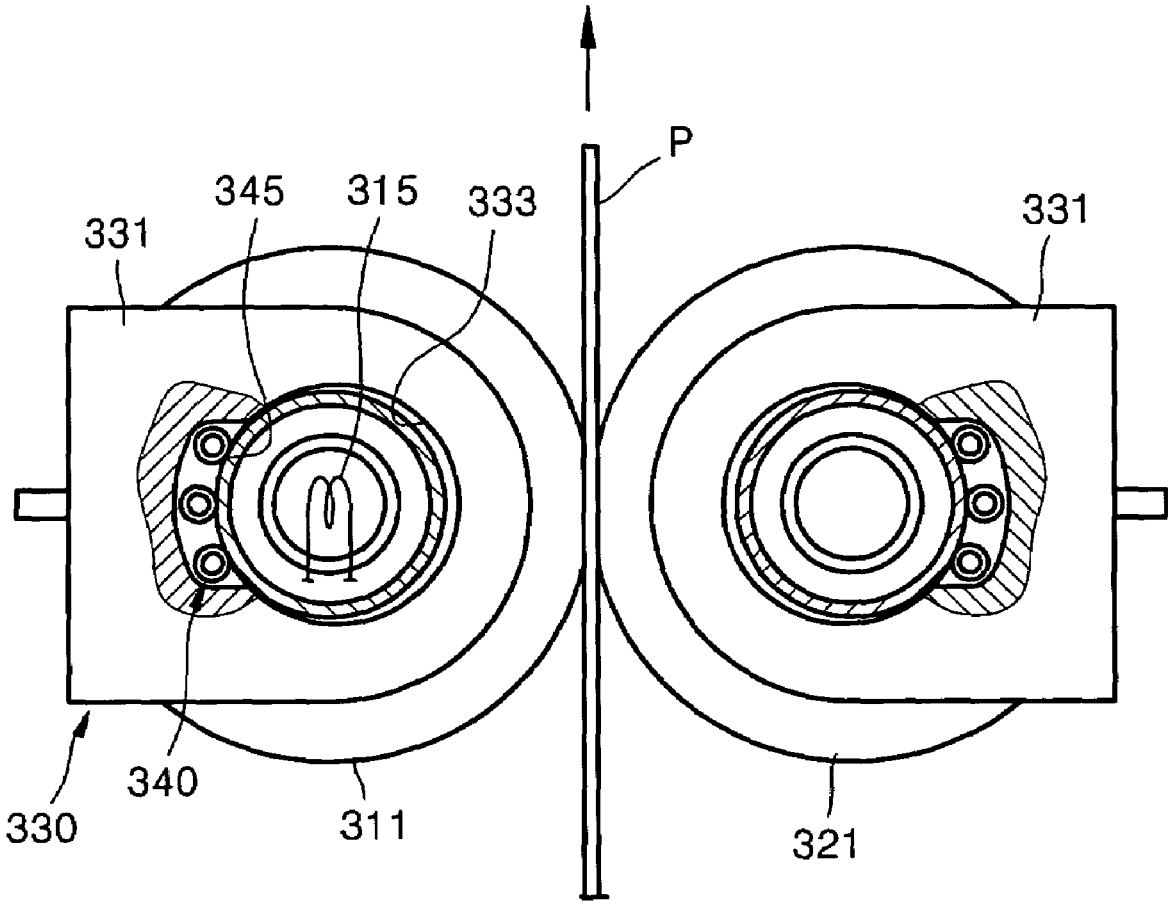
FIG. 12 is a schematic sectional view illustrating the operation of the fusing device shown in FIG. 11.

Referring to FIGS. 11 and 12, a fusing device for an image forming apparatus according to another exemplary embodiment of the present invention includes a fusing roller 311, and a pressure roller 321 rotatably installed in contact with the fusing roller 311. Bearing structures 330 for rotatably supporting the fusing roller 311 and the pressure roller 321 on a frame 301.

The fusing roller 311 is rotatably installed on the frame 301 through the bearing structure 330. A heater 315 is embedded inside the fusing roller 311. Accordingly, the fusing roller 311 cooperates with the pressure roller 321 to fuse an image transferred to a printing paper P at high temperature and high pressure. The fusing roller 311 and the pressure roller 321 rotate while mutually pressing the printing paper P passing therebetween, areas are formed in directions opposite to directions in which pressures are applied when the respective bearing structures 330 are coupled to the fusing roller 311 and the pressure roller 321 that have a narrower clearance than other areas.

Each of the bearing structures 330 includes a bearing body 331 having a fitting part 333 in which the fusing roller 311 or the pressure roller 321 is rotatably fitted, and a rolling support unit 340 installed on at least one portion inside the fitting part 333 for contacting the fusing roller 311 or the pressure roller 321 in a rolling manner. The rolling support unit 340 includes convex parts 345, which directly contact the fusing roller 311 and the pressure roller 321 in a rolling manner, and is disposed on an area with a narrower clearance on an inner surface of the fitting part 333, thereby helping the fusing roller 311 or the pressure roller 321 to rotate smoothly.

The bearing structures 330 illustrated in FIGS. 11 and 12 are substantially similar in structure and function to the bearing structures described with reference to FIGS. 8 through 10, and a detailed explanation thereof will not be given.

The bearing structures including the rolling support unit according to this exemplary embodiment support both the fusing roller and the pressure roller, and thus, it is possible that the bearing structure supports either the fusing roller or the pressure roller.

As described above, since the rolling support unit 340 is employed in the specific portion with the narrower clearance to contact the roller in a rolling manner, not in a frictional manner, friction between the bearing body 331 and the fusing roller 311 and the pressure roller 321 may be reduced.

Figure 13:
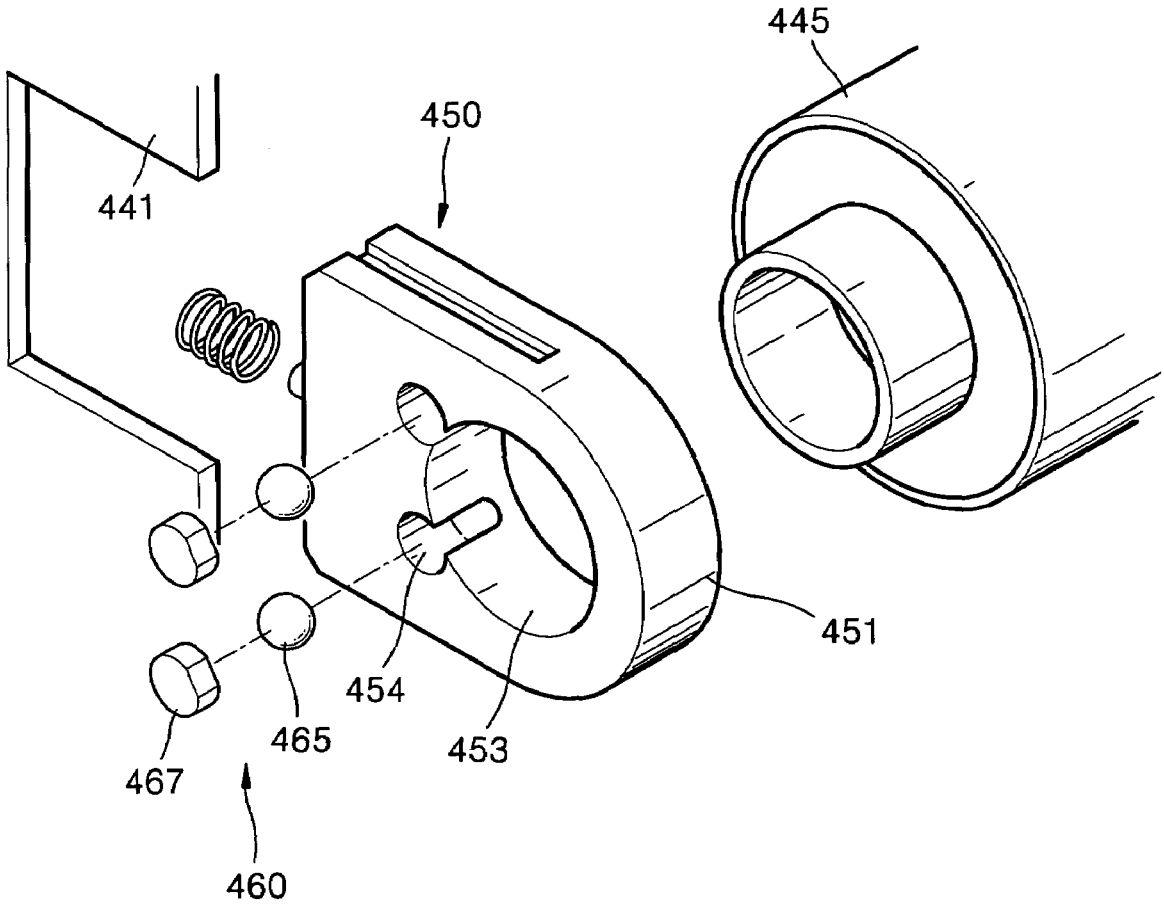
FIG. 13 is an exploded perspective view of a bearing structure according to a fifth embodiment of the present invention.

Referring to FIG. 13, a bearing structure 450 according to a further embodiment of the present invention is installed between a frame 441 and a rotary shaft 445 and rotatably supports the rotary shaft 445 on the frame 441. The bearing structure 450 includes a bearing body 451 having a fitting part 453 in which the rotary shaft 445 is rotatably fitted, and a rolling support unit 460, which is installed inside the fitting part 453 for contacting the rotary shaft 445 in a rolling manner.

The bearing structure 450 according to the exemplary embodiment illustrated in FIG. 13 is different from the bearing structure 250 according to the previous embodiment described with reference to FIGS. 8 and 9 in the structure of the rolling support unit 460. Accordingly, an explanation will be given focusing on the difference, and a detailed explanation of other elements will not be given.

To this end, the bearing body 451 has an installation groove 454 formed within at least one area of the fitting part 453. The rolling support unit 460 is inserted into the installation groove 454. Two installation grooves 454 may be installed as shown in FIG. 13, and one, or three or more installation grooves may also be installed.

The rolling support unit 460 includes at least one ball member 465, which is freely rotatably inserted into the installation groove 454. The ball member 465 directly contacts the rotary shaft 445 to guide the rotary shaft 445 to rotation. Preferably, the rolling support unit 460 further includes a cap member 467. The cap member 467 is attached to the installation groove 454 and prevents the ball member 465 from being removed from the installation groove 454. Preferably, the installation groove 454 extends at a lateral surface of the bearing body 451 in a longitudinal direction of the rotary shaft 445 in FIG. 13. That is, the installation groove 454 may be formed inside the bearing body 451 in a direction in which the rotary shaft 445 is pressed.

An exposed surface of the ball member 465 inserted into the installation groove 454 directly contacts the rotary shaft 445, thereby facilitating smooth rotation of the rotary shaft 445.

Figure 14:
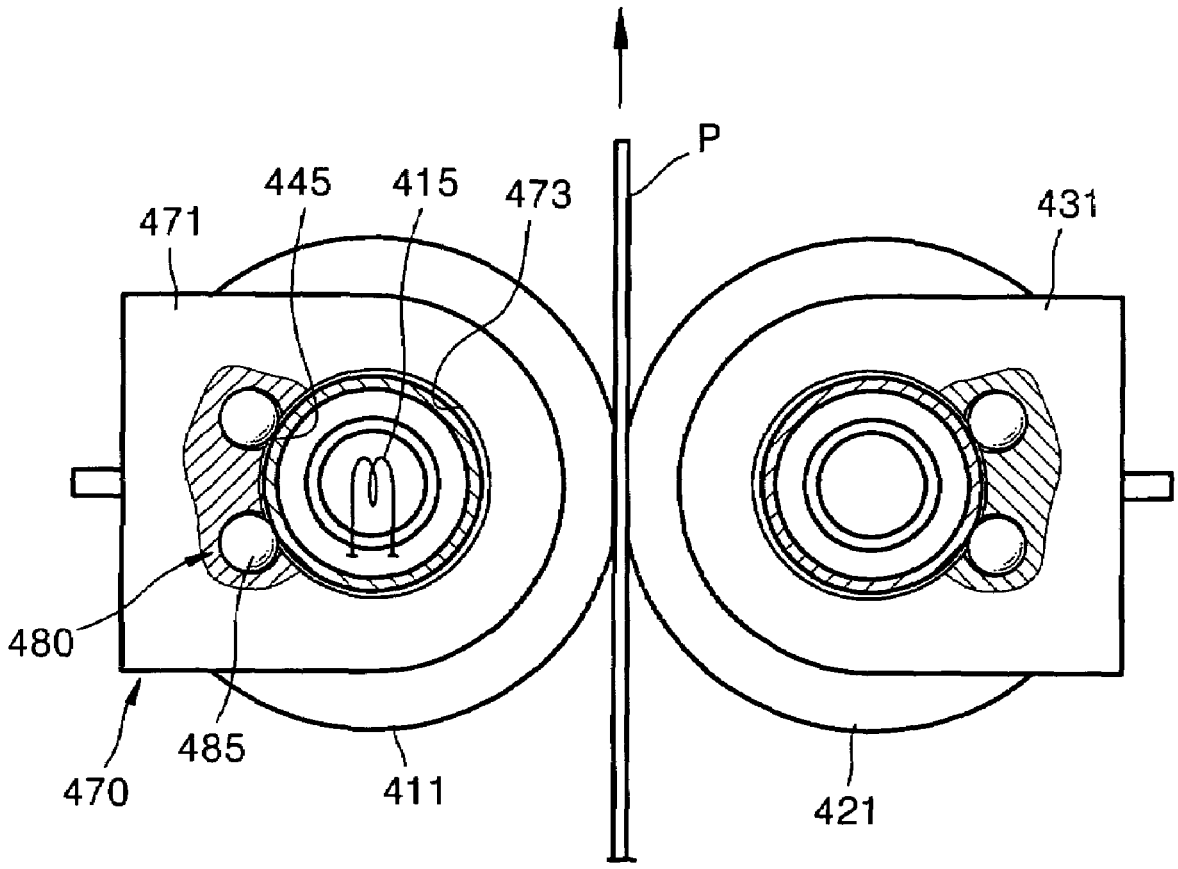
FIG. 14 is a schematic sectional view of a fusing device for an image forming apparatus having the bearing structure of FIG. 13, according to a fifth embodiment of the present invention.

Referring to FIG. 14, a fusing device for an image forming apparatus according to another exemplary embodiment of the present invention includes a fusing roller 411, and a pressure roller 421 rotatably installed in contact with the fusing roller 411. Bearing structures rotatably support the fusing roller 411 and the pressure roller 421 on a frame 401.

Since the fusing device illustrated in FIG. 14 is substantially similar to the fusing device of the previous embodiment described with reference to FIGS. 11 and 12 in the structure of the bearing structures 470, a detailed explanation of the fusing roller 411 and the pressure roller 421 will not be given.

Each of the bearing structures 470 includes a bearing body 471 having a fitting part 473 in which the fusing roller 411 or the pressure roller 421 is rotatably fitted, and a rolling support unit 480 installed on at least one portion inside the fitting part 473 for contacting the fusing roller 411 or the pressure roller 421 in a rolling manner. The rolling support unit 480 includes a ball member 485, which directly contacts the fusing roller 411 or the pressure roller 421 in a rolling manner, and is disposed on an area with a narrower clearance on an inner surface of the fitting part 473, thereby facilitating smooth rotation of the fusing roller 411 or the pressure roller 421. The bearing structure 470 is substantially identical in structure and function to the bearing structure of the previous embodiment described with reference to FIG. 13, such that a detailed explanation thereof will not be given.

Although the bearing structures including the rolling support unit according to this exemplary embodiment supports both the fusing roller and the pressure roller, the bearing structures may support either the fusing roller or the pressure roller.

As described above, since the rolling support unit 470 is employed in the specific portion with a narrower clearance to contact the roller in a rolling manner instead of frictionally, friction between the bearing body 431 and the fusing roller 411 and the pressure roller 421 may be reduced.

Since the bearing structure according to exemplary embodiments of the present invention employs the support belt, the convex part, or the ball member, which is operatively connected to the roller and rotates, friction between the roller and the bearing under a pressure may be reduced.

Further, if the rolling support unit of the bearing structure is manufactured as a separate independent member of the bearing body and then is coupled to the bearing body, the rolling support unit may be assembled and installed more easily, thereby reducing the number of assembling processes.

Moreover, since the fusing device for an image forming apparatus employs a modified sliding bearing instead of a ball bearing, problems caused when the ball bearing is employed may be solved fundamentally. In addition, since the rolling support unit includes the support belt, the convex part, or the ball member that contacts the bearing body in a rolling manner, friction may be reduced at portions under a high pressure, and foreign substances generated due to the friction are substantially prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A bearing structure installed between a frame and a rotary shaft to rotatably support the rotary shaft on the frame, comprising:

a bearing body slidably connected to the frame and having a fitting part in which the rotary shaft is rotatably fitted, the bearing body substantially surrounding the received portion of the rotary shaft, the fitting part having an installation groove formed within at least one area thereof, and the rolling support unit having at least one ball member freely rotatably inserted in the installation groove to contact the rotary shaft in a rolling manner;

an elastic member disposed between the frame and the bearing body to elastically press the bearing body to the frame in a predetermined direction;

a rolling support unit installed on a specific portion with narrower clearance between the fitting part and the rotary shaft but all inside the fitting part to contact the rotary shaft in a rolling manner; and a cap member attached to the installation groove and substantially preventing the ball member from being removed from the installation groove.

2. A fusing device for an image forming apparatus, comprising:

a fusing roller in which a heater is embedded;

a pressure roller that faces the fusing roller and cooperates with the fusing roller in pressing a sheet of paper passing therebetween; and bearing structures to rotatably support the fusing roller and the pressure roller on a frame, the bearing structures having a bearing body slidably connected to the frame and that has a fitting part in which at least one of the fusing roller and the pressure roller is rotatably fitted, the fitting part having an installation groove formed within at least one area thereof, and the rolling support unit having at least one ball member freely rotatably inserted in the installation groove to contact the rotary shaft in a rolling manner, the bearing body substantially surrounding the received portion of the roller, and a rolling support unit installed on a specific portion with narrower clearance between the fitting part and the rotary shaft inside the fitting part to contact the fitted roller in a rolling manner, an elastic member being disposed between the frame and each bearing body to elastically press the bearing body to the frame in a predetermined direction, and a cap member attached to the installation groove and preventing the ball member from being removed from the installation groove.

* * * * *